United States Patent [19]

Habets et al.

[11] 4,344,104

[45] Aug. 10, 1982

[54] CORONA DEVICE

[75] Inventors: Antonius H. M. Habets, Venlo; Henricus C. M. Krijnen, Asten, both of Netherlands

[73] Assignee: Oce-Nederland B.V., Venlo, Netherlands

[21] Appl. No.: 194,090

[22] Filed: Oct. 6, 1980

[30] Foreign Application Priority Data

Oct. 10, 1979 [NL] Netherlands ..... 7907492

[51] Int. Cl.[3] ..... H05F 3/06

[52] U.S. Cl. ..... 361/230; 313/351; 361/213; 361/221; 361/229

[58] Field of Search ..... 361/213, 212, 220, 221, 361/229, 230; 313/351

[56] References Cited

U.S. PATENT DOCUMENTS

| | | | |
|---|---|---|---|
| 1,093,491 | 4/1914 | Smith | 361/221 |
| 3,466,485 | 9/1969 | Arthur, Jr. et al. | 313/351 X |
| 3,671,798 | 6/1972 | Lees | 313/351 X |
| 3,720,856 | 3/1973 | Brody | 313/351 X |

*Primary Examiner*—Harry E. Moose, Jr.
*Attorney, Agent, or Firm*—Albert C. Johnston

[57] ABSTRACT

A corona device suitable for use in electrophotographic apparatus to provide a uniform charge on photoconductive material comprises as the ion-generating means a multiplicity of electrode pins, all of the same diameter, which are provided at the same mutual spacing from one another in a body of insulating material from which all the pins project to the same extent, with the pins limited to a diameter between 10 and 100 microns, a mutual spacing of between 0.3 and 2.5 mm, a projecting length of between 0.7 and 3 mm, a length to diameter ratio of between 10 and 300 and a spacing distance to diameter ratio of between 4 and 250. The electrode pins are formed from lengths of a suitable conductive wire which are laid at the required mutual spacing and soldered to and between conductive strips to form an electrically conductive unit that is embedded in a cast body of the insulating material with free ends of the wire lengths projecting to the required extent.

3 Claims, 7 Drawing Figures

CORONA DEVICE

The present invention relates to a corona device suitable for use in an electrophotographic apparatus, of a type in which electrode pins serving as the ion generating element are provided at the same mutual spacing each from another in a body of insulating material and all the pins have the same diameter and project to the same extent beyond the surface of the body of insulating material.

Corona devices of that type are generally used in an electrophotographic apparatus for charging a photoconductive element or for the creation of an ionizing field when required in order to transfer a powder image from the photoconductive element to a receptor material. When connected to a high voltage, each electrode pin generates an ion cloud which extends from the pin toward a counter-electrode. A material that is to be charged up, such as a photoconductive element, is located between the pins and the counter-electrode.

Such corona devices exhibit a disadvantage in that the respective ion clouds of the electrode pins repel one another, thus giving rise to irregular charge patterns on the material to be charged.

The present invention is based on the discovery that the stated disadvantage can be overcome by employing a very definite choice for the diameter and the location of the electrode pins.

A corona device in accordance with the invention is provided with electrode pins as described above and, in addition, is characterized by the fact that the diameter of the electrode pins is between 10 and 100 microns, the distance between the electrode pins is between 0.3 and 2.5 mm, the pins project a distance of between 0.7 and 3 mm beyond the body of insulating material, the ratio of the length of the pins to their diameter is between 10 and 300, and the ratio of the distance between the pins to their diameter is between 4 and 250.

A corona device in which the electrode pins conform with these limitations provides a uniform charge on the material to be charged and functions over a wider range of high voltages than the corona devices conventionally employed.

Preferably the diameter of the pins of the corona device is limited to between 20 and 75 $\mu$m, with the pins projecting a distance of between 0.9 and 2 mm beyond the body of insulating material, and the distance between the pins is limited to between 0.5 and 1.5 mm.

The pins of the corona device can be made of materials such as those used for wire coronas. Materials especially suitable for the pins are, for example, wires of tungsten, of stainless steel, and of tungsten plated with a thin layer of gold. As the insulating material of the body holding the pins use preferably is made of ozone-resistant insulating plastics, such, for example, as polyester resins.

As a further feature of the invention, an advantageous structure of the corona device is provided which can be produced satisfactorily with pins formed from cut lengths of a proper wire stock, which lengths are soldered at the required precise mutual spacing to and between conductive strips to form a conductive unit that is largely embedded in a cast body of the insulating material.

The invention will be further understood from the following detailed description and the accompanying drawings of an illustrative corona device embodying the invention and of a method of manufacturing the device. In the drawings.

Figure 1:
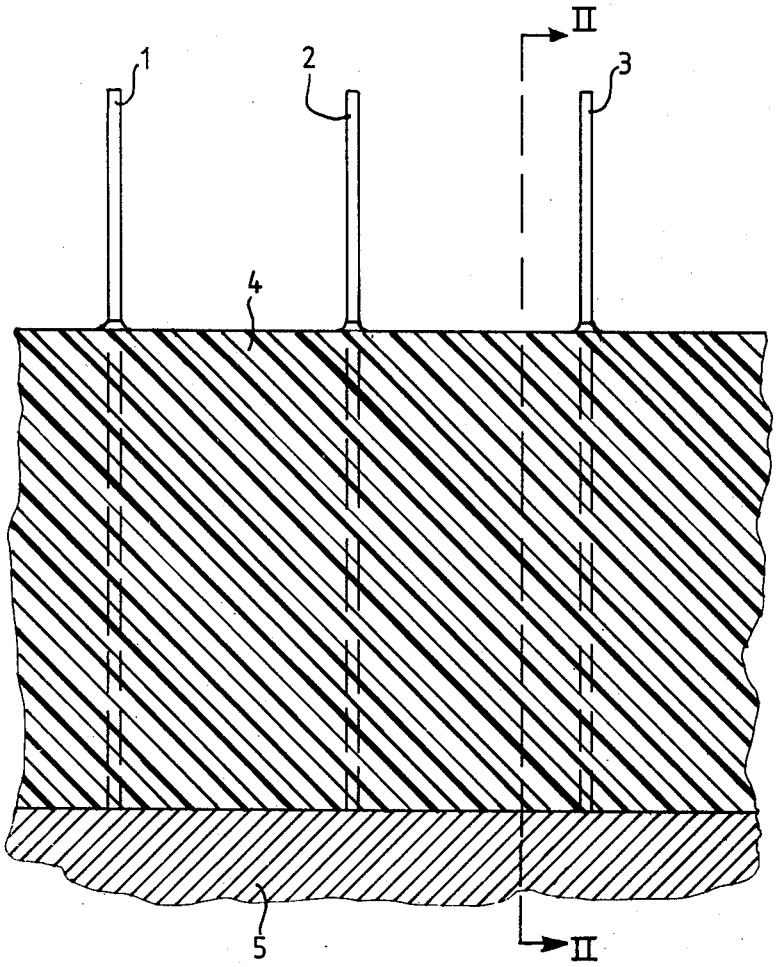
FIG. 1 is a greatly enlarged sectional view showing several of the electrode pins in the corona device.
Figure 2:
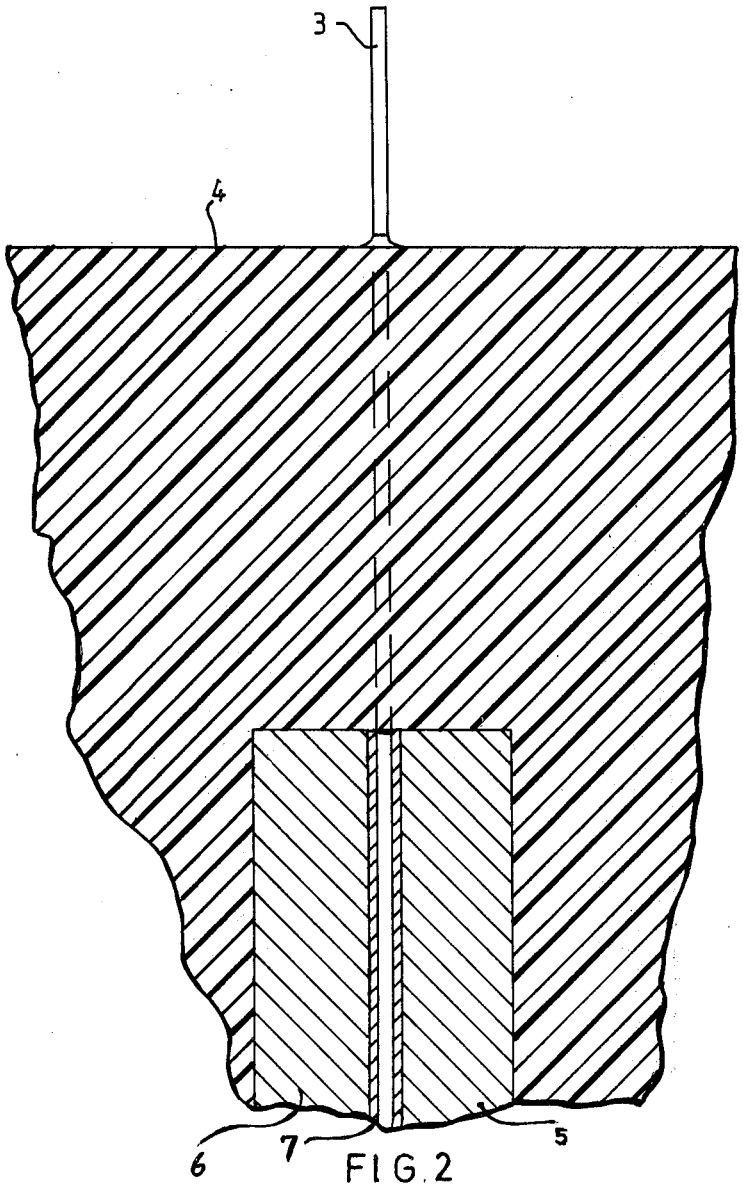
FIG. 2 is a cross sectional view of one of the pins, taken along the line II—II in FIG. 1.

FIG. 1 shows a portion of a corona device in which several illustrative electrode pins 1, 2, 3 are contained in a body 4 of insulating material. The electrode pins of the corona device are all of the same diameter and all project the same distance or length beyond the body 4. The pins are electrically connected with each other and with conductive connecting elements 5 and 6, e.g. by means of a layer of solder 7 (FIG. 2). The connecting elements 5 and 6 are metal strips which can be connected with a high voltage source for the generation of a corona discharge at the free ends of the pins.

Figure 3:
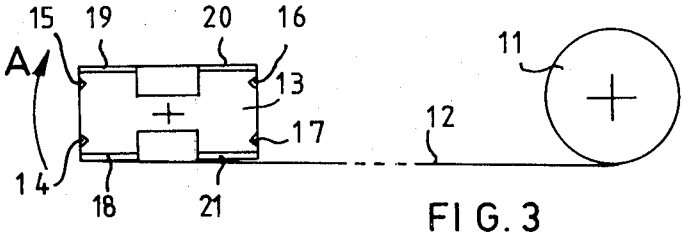
FIGS. 3, 4, 5, 6 and 7 are diagrammatic representations of consecutive stages of manufacture of a corona device in accordance with the invention.

FIGS. 3–7 illustrate details of consecutive stages of a method for making a corona device in accordance with the invention. In FIG. 3, numeral 11 denotes a stock roll of wire 12 from which the electrode pins are made, the diameter of which corresponds to the desired diameter of the pins and amounts, preferably, to between 20 and 75 microns. The wire 12 is led from the roll 11 to a mandrel bar 13 having an H-shaped profile, which bar is carried by a winding machine (not shown) in such manner that the bar can be rotated around its longitudinal axis in the direction of arrow A. The opposite end edges of the bar 13 are provided with notches 14, 15, 16 and 17 recessed in the longitudinal direction. Four strips 18, 19, 20 and 21 of an electrically conductive material, such as brass, are fastened detachably to the opposite longitudinal side edges of the bar 13, with each of these strips extending perpendicular to the plane of the bar.

In an initial stage, as indicated in FIG. 3, the wire 12 is wound around the assembly of the bar 13 with a set of the strips 18, 19, 20 and 21. This winding is effected so as to space the successive convolutions of the wire at a distance apart, or pitch, equal to the desired spacing between the electrode pins; for instance, at a spacing of 1 mm.

Figure 4:
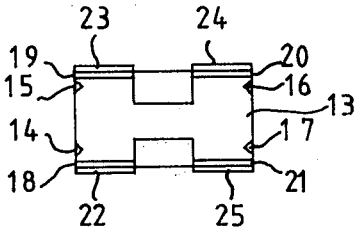

When the winding process has been completed, a second stage takes place as indicated in FIG. 4. In this stage, the convolutions of the wire 12 are fixed in place relative to the strips 18, 19, 20 and 21 by applying a layer of solder to these strips and over the lengths of wire laid on them, and fastening to them by the solder the strips 22, 23, 24 and 25, respectively, of a second set of electrically conductive strips.

Figure 5:
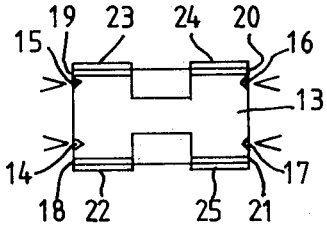

Subsequently, as indicated by the symbols in FIG. 5, the convolutions of the wire 12 are cut at locations aligned with the bottoms of the notches 14, 15, 16 and 17. This cutting gives two, substantially identical assemblies of wire lengths soldered and sandwiched between conductive strips. Each of these assemblies consists of two pairs of strips soldered to each other, such as the pair 19, 23 and the pair 20, 24, with a large number of wires properly spaced apart and anchored conductively between the strips of each pair. At least one of the strips of each of the assemblies 18, 22, 21, 25 and 19, 23, 20, 24, respectively, is also provided with a connecting element, such as a pin soldered to the strip, for connecting the strips with a voltage source.

Figure 6:
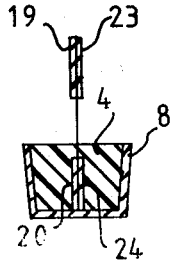
Figure 7:
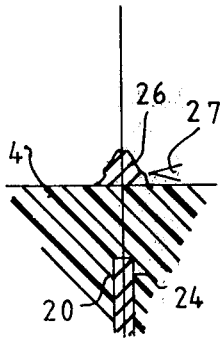

The two assembles of wires and strips are detached from the mandrel bar 13, after which each of these assemblies is processed further as indicated in FIGS. 6 and 7. One of the strip pairs of the assembly, such as that of strips 20 and 24 are shown in FIG. 6, is placed in a channel-shaped covering 8 of insulating material. The other pair of the same assembly, as formed by the strips 19 and 23, serves as a spacing element by means of which the wires joining the two pairs of strips can be kept tensioned so that no bends or buckles will occur in the wires between the two pairs of strips. Then a mass of insulating material, such as a self-hardening liquid polyester resin, is poured into the channel-shaped covering 8 until it is filled to the brim and the strips 20 and 24 are completely covered, as indicated at 4 in FIG. 6.

After the insulating material has become solid, the wires protruding from the body of this material are held in a fixed position by a mass 26 of a low melting point wax applied about them, as indicated in FIG. 7. Then, during a final stage shown in FIG. 7, the wires are cut off to the required distance of projecting from the insulating body, for instance to a length of 1.5 mm from its surface. The cutting can be effected by use of a cutting element or knife 27 passed through the mass of wax holding each wire upright from the insulating body. The length of wire left to serve as an electrode pin is the same for all wires, measured from the surface of the insulating material 4. The wax 26 eventually is removed by heating.

The wires can also be held fixed during the cutting in other ways. For example, one or more flat elements the thickness of which corresponds to the desired length of the electrode pins can be placed on the surface of the insulating material 4 and pressed against the wires, followed by movement of a knife over the surface of the flat element to cut off the excess length of the wires. It will also be apparent that the order of steps in the manufacturing process can be varied from the described above; for instance, the wires joining the pairs of sandwiched strips can first be cut to length and subsequently the whole of a pair of strips with wires protruding from between them can be embedded in poured insulating material until the required precise length of the electrode pins remains above the surface of the resultant body of insulating material.

What is claimed is:

1. A corona device suitable for use in an electrophotographic apparatus, comprising as ion-generating means a multiplicity of electrode pins provided at the same mutual spacing each from another in a body of insulating material, all the said pins having the same diameter and projecting to the same extent beyond the surface of said body, wherein said electrode pins have a diameter of between 10 and 100 microns and are spaced apart mutually by a distance of between 0.3 and 2.5 mm, and they project a distance of between 0.7 and 3 mm beyond the body of insulating material, the ratio of the length of said pins to their diameter being between 10 and 300 and the ratio of the distance between the pins to their diameter being between 4 and 250.

2. A corona device according to claim 1, the diameter of said pins being between 20 and 75 microns, the spacing distance between them being between 0.5 and 1.5 mm, and their distance of projection from said body being between 0.9 and 2 mm.

3. A corona device according to claim 1 or 2, said ion-generating means comprising a row of said pins constituted by substantially identical lengths of an electrically conductive wire, said wire lengths being laid each next to another at said mutual spacing distance and having base portions thereof soldered to and between electrically conductive strips joined together by the solder, said strips and portions of said wire lengths extending therefrom being embedded in a body of an ozone-resistant insulating plastic cast about them, said wire lengths having free end portions protruding from said body by said distance of projection, and at least one of said strips having a conductive element fixed thereto for connecting said strips and said wire lengths with a source of high voltage.

* * * * *